US006832937B1

(12) United States Patent
Wrede et al.

(10) Patent No.: US 6,832,937 B1
(45) Date of Patent: Dec. 21, 2004

(54) SUBASSEMBLY FOR FORMING AN ELECTRICAL CONNECTOR COMPONENT

(75) Inventors: Bernhard Wrede, Lüdenscheid (DE); Dietmar Kammerer, Ludwigsburg (DE)

(73) Assignee: Leopold Kostal GmbH & Co. KG, Ludenscheid (DE)

( * ) Notice: Subject to any disclaimer, the term of this patent is extended or adjusted under 35 U.S.C. 154(b) by 28 days.

(21) Appl. No.: 10/664,330

(22) Filed: Sep. 17, 2003

(30) Foreign Application Priority Data

Sep. 17, 2002 (DE) ..... 102 43 256

(51) Int. Cl.[7] ..... H01R 13/514
(52) U.S. Cl. ..... 439/752; 439/358; 439/701
(58) Field of Search ..... 439/752, 358, 439/347, 352, 354, 701, 904

(56) References Cited

U.S. PATENT DOCUMENTS 6,450,840 B2 * 9/2002 Nakamura ..... 439/752

FOREIGN PATENT DOCUMENTS

DE 696 13 197 T2 11/1996
EP 1 126 556 A2 11/2000

* cited by examiner

*Primary Examiner*—Tho D. Ta
(74) *Attorney, Agent, or Firm*—Brooks Kushman P.C.

(57) ABSTRACT

A subassembly for forming an electrical plug connection component, formed by a contact element housing 2 with chambers K for seating electrical contact elements, whereby the chambers have a radial opening 4 as the engagement opening for a locking element 11 for latching a contact element that is inserted into each chamber K, and by a latching part 3 that can be connected with the contact element housing 2 and that has at least one locking element 11, such that the latching part 3, which is found in at least two different spatial locations, can be assembled with the contact element housing 2, and that assigned to the latching part 3 is a latching device 15 for the mechanical latching of the plug connection component formed by the subassembly 1 with a mating plug connection component.

9 Claims, 2 Drawing Sheets

SUBASSEMBLY FOR FORMING AN ELECTRICAL CONNECTOR COMPONENT

BACKGROUND OF THE INVENTION

1. Field of the Invention

The invention pertains to a subassembly for forming an electrical plug connection component, formed by a contact element housing with chambers for seating electrical contact elements, whereby the chambers have a radial opening as the engagement opening for a locking element for latching a contact element that is inserted into each chamber, and by a latching part having at least one locking element that can be connected with the contact element housing.

2. Background Art

Such subassemblies are used for forming electrical plug connection components, which can be configured as male plug connection components or female plug connection components after they have been equipped with pin contacts or socket contacts. The contact element housing of such a subassembly is used for seating the electrical contact elements and includes for this purpose several chambers arranged in one or more rows. The contact elements that are to be inserted into such a chamber include a spring clip, which faces opposite the assembling direction and which acts in cooperation with a web protruding into the chamber in order to achieve a primary latching of such a contact element in a chamber of the contact element housing.

To increase the functional reliability of such an electrical plug connection component, it is desired that the electrical contact elements are secondarily latched into the chambers of the contact element housing by additional means. Each chamber has for this purpose a radial opening, into which, for the secondary latching of the contact element inserted into such a chamber, a locking element that can be connected with the contact element housing is inserted. This locking element is part of a latching part that is fastened after the equipping of the chambers of the contact element housing in order to bring about the desired secondary latching to the contact element housing. In addition, such a contact element housing includes mechanical latching means so that the plug connection component formed by this subassembly can be latched with a mating plug connection component.

In principle, different subassemblies can be formed using one and the same latching part, in that different contact element housings are assembled using the latching part. In this way, different variants of one subassembly can be formed, for example, by different insertion codings for the mating plug connection component. Such codings are assigned to the contact element housing so that for forming different variants of one subassembly, differently designed contact element housings have to be available, which must always have the mechanical latching means for latching a mating plug connection component affixed at the same location.

The same number of different contact element housings is thus needed as the number of different subassemblies. Consequently, the inventory maintenance costs and the tool costs in particular are factors that should not be underestimated, so that as a general rule, a new tool for producing a contact element housing does not pay from an economic standpoint unless the contact element housing produced with it can be produced and sold in large enough quantities.

SUMMARY OF THE INVENTION

The invention is therefore based on the task of further developing a generic subassembly of the type mentioned above in such a way that two or more variants of a subassembly can be formed using a single contact element housing.

According to the invention, this task is solved in that the latching part, which is found in at least two different spatial locations, can be assembled with the contact element housing, and that assigned to the latching part is a latching device for the mechanical latching of the plug connection component formed by the subassembly with a mating plug connection component.

With this subassembly, the contact element housing, which is found in different spatial locations, can be assembled with the latching part to form different variants of a subassembly or to form different subassemblies. A latching device is assigned to the latching part in order to be able to produce the desired latching with a mating plug connection component. With respect to the desired connection with a mating contact element part, the contact element housing can thus be connected with the latching part in virtually any spatial location, specifically while assuring a consistent positioning of the latching device.

As a result, it is possible to contact different variants of a subassembly with one and the same mating plug connection component. For example, to form variants of a subassembly it can be provided that the contact element housing is arranged relative to the latching part rotated by 180° around its longitudinal axis. Different variants can be identified by different equipping and/or different labeling of the contact element housing. For example, different variants can be distinguished by means of a housing coding on the contact element housing, which, for example, in the case of one variant, is placed relative to the coding of the latching part on the left side of the coding and in the case of another variant is located on the right side of the coding of the latching part as a result of a rotation of the contact element housing by 180°. In this case, the coding could be a so-called 180° coding, for example.

It becomes clear from the description of this subassembly that in order to make possible the desired different assembling of the contact element housing and the latching part, both elements must include connection means that are matched to each other, by means of which the desired variability of assembling is possible. That is the case, for example, if the latching part is formed like a clasp, the legs of which surround the contact element housing from a narrow side. The contact element housing can be inserted by one or the other of its narrow sides into such a clasp-like or U-shaped recess in the latching part.

For guiding the two elements, with such a design it is advisable to provide that the contact element housing have one or more guide grooves, into which complementary designed guide elements of the latching part engage. In a similar way, the desired variability can also be achieved by using catch or clip connection elements. The latching device of the latching part of the subassembly is also advantageously used as insertion coding for the correctly positioned connection of a mating plug connection component.

A locking bar that has a barb-like configuration and is formed onto a spring clip, and that works in cooperation with a limit stop assigned to the mating plug connection component can be used to latch the subassembly with a mating plug connection component in order to secure the plug connection. Webs placed parallel to the spring clip can be used to protect the spring clip and, in particular, to provide an insertion coding as well. The webs can—as is provided in the embodiment—make a transition into a collar that surrounds the free end of the spring clip. Such a collar is intended to prevent the spring clip from being bent outward or broken off during handling of the subassembly.

BRIEF DESCRIPTION OF THE DRAWING

The invention is described below with the aid of an embodiment and references to the following Figures.

DETAILED DESCRIPTION OF THE PREFERRED EMBODIMENT(S)

Figure 1:
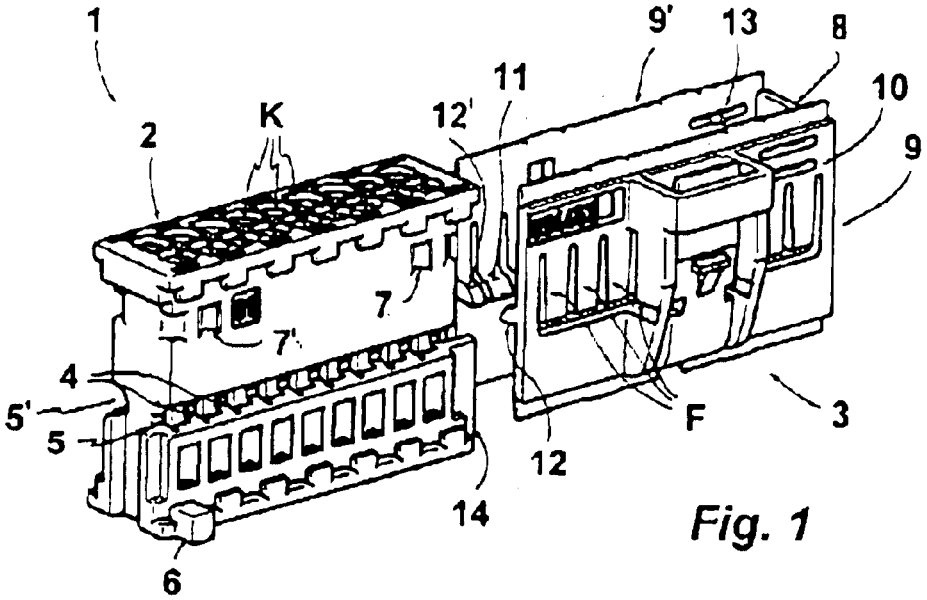
FIG. 1 illustrates a three-dimensional view of a subassembly in a pre-installed position, including a contact element housing and a latching part.

A subassembly, identified in its entirety by reference symbol 1, for forming an electrical plug connection component includes a contact element housing 2 and a latching part 3. Contact element housing 2 has a plurality of chambers K, into which the electrical contact elements for forming the electrical plug connector—pin parts or socket parts—are inserted. In the embodiment shown, contact element housing 2 is designed with two rows. Nine chambers K are placed in each row.

Placed radially to each chamber K and opening into each is a latching opening 4, into which means for the secondary latching of the electrical contact elements inserted into the chambers K engage. Latching openings 4 of chambers K are arranged aligned with each other in a row. Openings 4 are located in a guide groove 5 that follows the wide side of contact element housing 2. Guide groove 5 is open where it borders the two narrow sides of contact element housing 2. Contact element housing 2 bears on its side for contacting by a mating plug connection component an insertion coding 6. Coding 6 is designed as a protruding peg in the case of the embodiment shown.

Additionally worked into the surface of contact element housing 2 are catch recesses 7, 7' for securing latching part 3 relative to the contact element housing in the assembled state. The back of contact element housing 2, which cannot be seen in FIG. 1, is constructed in the same way, whereby on the back the insertion coding is located at the right rear side.

Latching part 3 is designed with a U-shape, i.e., in a clasp-like fashion, and includes two individual locking element arrangements 9, 9' that are connected to each other by a transverse web 8. Locking element arrangements 9, 9' are—to the extent that it is of importance for the object of this invention—constructed in the same way. In the embodiment shown, latching element 3 includes two locking element arrangements 9, 9', because contact element housing 2 is made in two rows and a locking element arrangements 9, or 9' is thus assigned to each row of chambers.

In the following, then, only locking element arrangement 9 will be described. Locking element arrangement 9 includes an upper, plate-like base 10, on which—separated from each other by notches—are formed individual spring clips F that protrude along the longitudinal extent of chambers K of contact element housing 2. As latching part 3 is made of plastic, spring clips F are furnished with a certain material elasticity, so that they can be moved elastically from the plane of base 10 and thus radially to chambers K of contact element housing 2.

Formed onto the free end of each spring clip F is a locking bead 11, which, in its normal position, engages in a latching opening 4. As a result of the material-elastic properties of spring clips F, with individual chambers K of contact element housing 2 so equipped, locking bead 11 of each spring clip F can be moved radially by the contact element inserted into chamber K out of its securing position engaged with the chamber K, until locking bead 11 springs back into the provided latching slope of the contact element as a result of the material-elastic properties of spring clips F. In this way, a latching of the contact elements inserted into chambers K of contact element housing 2 takes place passively. Equipping contact element housing 2 can be undertaken with the assembled subassembly 1.

To guide latching part 3 and to secure same on contact element housing 2, the latching part has at its disposal guide pegs 12, 12' that are placed protruding inward from locking element arrangements 9 and 9' into the seat of latching part 3. Guide pegs 12, 12' engage in guide grooves 5, 5' of contact element housing 2. Locking beads 11 of spring clips F are placed aligned with guide pegs 12 and 12', so that as a result of the total number of locking beads 11 and guide pins 12, 12', in the end one guide strip each is made available. Protruding inwardly from base 10 in question and provided in protruding fashion is a catch lobe 13, which engages in a catch recess 7 and 7' in order to latch latching part 3 to contact element housing 2.

Figure 2:
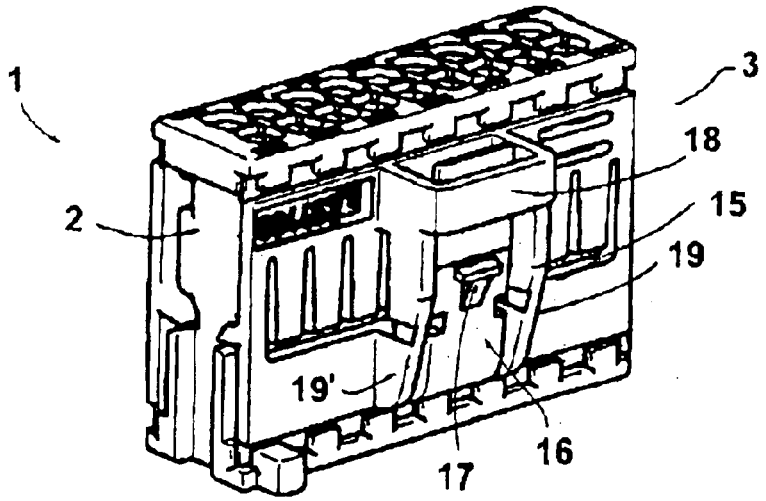
FIG. 2 illustrates the subassembly formed from the two individual elements of FIG. 1.
Figure 3:
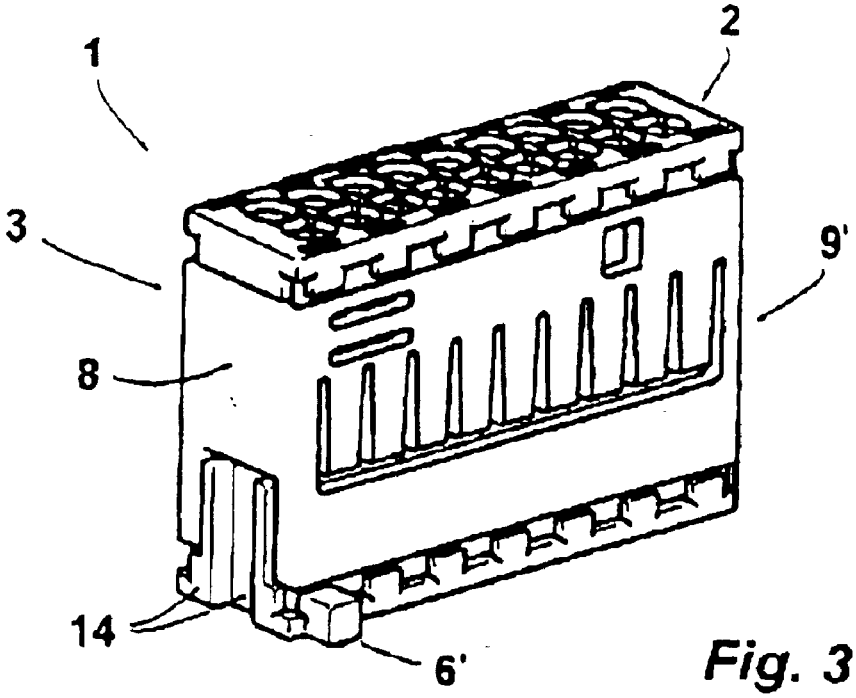
FIG. 3 illustrates the subassembly of FIG. 2 in a rear view.

The assembled subassembly 1, including contact element housing 2 and latching part 3, is shown in FIG. 2. In the assembly shown in FIG. 2, contact element housing 2 has been inserted with its right narrow side in the recess formed by latching part 3. Protruding from the right narrow side of contact element housing 2 is a so-called 180° coding 14. FIG. 3 illustrates the rear view of subassembly 1 and, in particular, transverse web 8 that connects the two locking element arrangements 9, 9', along with insertion coding 6'.

In addition, latching part 3 also bears a latching device, identified in its entirety by reference symbol 15, for latching the electrical plug connection component formed by subassembly 1 with a mating plug connection component. Latching device 15 is assigned to locking element arrangement 9. Latching device 15 includes a locking bar 17 that has a barb-like configuration and is formed onto an elastic clip 16, and that works in cooperation with a limit stop assigned to the mating plug connection component to bring about the desired latching. Clip 16 extends from the region of, relative to the connection with a mating plug connection component, the insertion-side end of subassembly 1 all the way to the back region.

In the back region, the clip, which is also used for unlatching the mating plug connection component, is surrounded by a collar 18. Collar 18 serves to protect clip 16, especially against any unintentional opening of locking bar 17 during handling of subassembly 1. Collar 18 continues in two webs 19, 19', which are placed along the level of latching part 3 and adjacent to clip 16, and which also serve to protect locking bar 17 as well as the clip. Webs 19, 19' and latching device 15 additionally serve as insertion coding, because subassembly 1 has only one latching device 15, as becomes clear in the rear view of FIG. 3. In this view it can be seen that there is no latching device assigned to locking element arrangement 9'.

Figure 4:
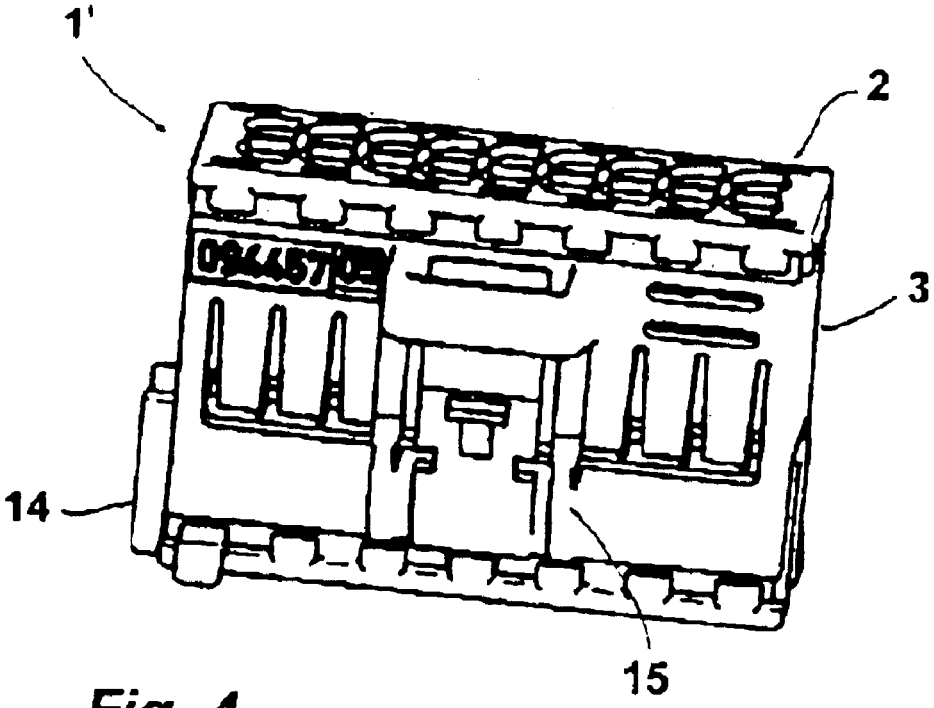
FIG. 4 illustrates subassembly including the contact element housing and the latching part according to FIGS. 1–3.

The described design of contact element housing 2 and latching part 3 makes it possible for the contact element housing to be assembled in two different spatial locations with latching part 3 in order to form different subassemblies. One of these possibilities has already been shown in FIGS. 1–3 and described. Contact element housing 2 can also be rotated around its longitudinal axis by 180°, and can thus be inserted by its other narrow side, which bears the 180° coding, into the recess of latching part 3 so that an additional subassembly 1' is formed from elements 2, 3. Subassembly 1' is shown in FIG. 4. The 180° coding is now located on the left side of subassembly 1'.

Thus, using contact element housing 2 and latching part 3, two different subassemblies or variants of one subassembly can be formed without additional parts being required, and in particular, while ensuring that the subassemblies 1, 1' can be contacted by one and the same mating plug connection component.

LIST OF REFERENCE SYMBOLS

1, 1' Subassembly
2 Contact element housing
3 Latching part
4 Latching opening
5, 5' Guide groove
6, 6' Insertion coding
7, 7' Catch recess
8 Transverse web
9, 9' Locking element arrangement
10 Base
11 Locking bead
12, 12' Guide pegs
13 Catch lobe
14 180° coding
15 Latching device
16 Clip
17 Locking bar
18 Collar
19,19' Web
F Spring clip
K Chamber

What is claimed is:

1. A subassembly for forming two variants of an electrical plug connection component, the subassembly comprising:

a contact element housing having chambers for seating electrical contact elements, the chambers having a latching opening for engagement with a locking element in order to latch electrical contact elements inserted into the chambers; and a latching part connectable with the contact element housing in each one of two different ways to form two variants of an electrical plug connection component, wherein the latching part and the contact element housing are arranged in a first orientation relative to each other when connected in the first way to form the first variant of the electrical plug connection component, and the latching part and the contact element housing are arranged in a different second orientation relative to each other when connected in the second way to form the second variant of the electrical plug connection component;

the latching part including a locking element for engaging the latching opening of the contact element housing when the latching part and the contact element housing are connected;

the latching part further including a latching device for latching each formed variant of the electrical plug connection component with a mating plug connection component.

2. Subassembly according to claim 1, wherein the contact element housing includes an insertion coding for contact with the mating plug connection component for the correctly positioned connection of the electrical plug connection component formed by the subassembly with the mating plug connection component.

3. Subassembly according to claim 1 wherein the latching part has two formed-on prolongations that surround the contact element housing on the side, with latching means for fastening the latching part to the contact element housing when the latching part and the contact element housing are connected.

4. Subassembly according to claim 1, wherein the latching device includes a locking bar having a barb-like configuration and being formed onto a spring clip of the latching part.

5. Subassembly according to claim 4, wherein the latching device includes webs that surround the spring clip in a plugging direction of the mating plus connection component and protrude from the surface of the latching part.

6. Subassembly according to claim 5, wherein the webs make a transition into a collar that surrounds the spring clip at its free ends.

7. Subassembly according to claim 1 wherein the latching part is formed like a clasp, by means of which the contact element housing is surrounded from one of its sides when connected to the latching part.

8. Subassembly according to claim 7, wherein the latching part includes guide elements that engage in a guide groove of the contact element housing when the latching part and the contact element housing are connected.

9. Subassembly according to claim 7, wherein the latching part is held on the contact element housing by a catch or clip connection element when the latching part and the contact element housing are connected.

* * * * *

UNITED STATES PATENT AND TRADEMARK OFFICE

CERTIFICATE OF CORRECTION

PATENT NO. : 6,832,937 B1
DATED : December 21, 2004
INVENTOR(S) : Bernhard Wrede et al.

It is certified that error appears in the above-identified patent and that said Letters Patent is hereby corrected as shown below:

Column 6,
Line 34, delete “plus” and insert -- plug --.

Signed and Sealed this

Fifth Day of April, 2005

JON W. DUDAS
*Director of the United States Patent and Trademark Office*